United States Patent [19]

Hovis, Jr. et al.

[11] 4,385,943

[45] May 31, 1983

[54] CORROSION-RESISTANT URANIUM

[75] Inventors: Victor M. Hovis, Jr., Kingston; William C. Pullen, Knoxville; Thomas G. Kollie, Oak Ridge; Richard T. Bell, Knoxville, all of Tenn.

[73] Assignee: The United States of America as represented by the United States Department of Energy, Washington, D.C.

[21] Appl. No.: 313,414

[22] Filed: Oct. 21, 1981

[51] Int. Cl.[3] ..... B32B 15/00; B32B 15/20

[52] U.S. Cl. ..... 148/31.5; 376/417; 428/632; 428/649; 428/656; 428/658

[58] Field of Search ..... 428/655, 656, 629, 632, 428/633, 649, 666, 667, 926, 658; 376/416, 417; 148/31.5

[56] References Cited

U.S. PATENT DOCUMENTS

| | | | |
|---|---|---|---|
| 2,872,401 | 2/1959 | Wigner | 428/655 |
| 2,969,309 | 1/1961 | Finniston et al. | 428/655 |
| 4,137,370 | 1/1979 | Fujishiro et al. | 428/668 |
| 4,208,453 | 6/1980 | Baldi | 376/417 |

OTHER PUBLICATIONS

Lyman, T., et al.; Ed., *Metals Handbook* vol. 2, 8th Edition, pp. 547, 628, TA472 A3, (1964).

Wiederholt, *The Chemical Surface Treatment of Metal*, Robert Draper Ltd., pp. 145–211, (1965).

*Primary Examiner*—Michael L. Lewis

*Attorney, Agent, or Firm*—Earl L. Larcher; Stephen D. Hamel; Richard G. Besha

[57] ABSTRACT

The present invention is directed to the protecting of uranium and uranium alloy articles from corrosion by providing the surfaces of the articles with a layer of an ion-plated metal selected from aluminum and zinc to a thickness of at least 60 microinches and then converting at least the outer surface of the ion-plated layer of aluminum or zinc to aluminum chromate or zinc chromate. This conversion of the aluminum or zinc to the chromate form considerably enhances the corrosion resistance of the ion plating so as to effectively protect the coated article from corrosion.

1 Claim, No Drawings

CORROSION-RESISTANT URANIUM

This invention was made as a result of a contract with the U.S. Department of Energy.

BACKGROUND OF THE INVENTION

The present invention relates generally to corrosion-resistant uranium, and more particularly, to a method of providing metallic uranium and alloys thereof with a corrosion-resistant coating of aluminum chromate or zinc chromate.

Metallic uranium and many uranium alloys are highly reactive and undergo deleterious corrosion upon contact with gaseous and liquid mediums including air and water. Investigations have been conducted in an effort to minimize this corrosion problem. Efforts for alleviating uranium corrosion include such protective measures as alloying, coating uranium with plastic, covering exposed surfaces with layers of nickel or aluminum applied by vapor deposition electroplating and the like. These techniques for protecting uranium from corrosion have met with some success but the practice of these techniques is often very difficult and cumbersome with the resulting corrosion barrier often failing to be sufficiently reproducible for accomplishing its intended purpose. For example, the tendency of uranium surfaces to become passive after pre-plating treatment often renders uranium a highly difficult metal to successfully plate. Further, impervious protective platings are not easily achieved, particularly when the coating or plating is relatively thin in the order of about one-thousandth of an inch or less.

SUMMARY OF THE INVENTION

Accordingly, it is the primary aim or objective of the present invention to provide exposed surfaces of uranium and uranium alloys with a protective layer or coating of aluminum chromate or zinc chromate which is very adherent, hard and sufficiently resistant to penetration by corrosion-producing reactants so as to effectively inhibit corrosion of the uranium even when exposed to severe corrosion inducing conditions such as during prolonged exposures to heated air containing water vapor.

Generally, the method of the present invention is achieved by providing exposed surfaces or uranium or uranium alloys with a layer of an ion-plated metal selected from the group consisting of aluminum and zinc and then converting at least a surface portion of the plated layer to a chromate thereof. The conversion of the ion-plated aluminum or zinc to aluminum chromate or zinc chromate respectively, provides unexpected corrosion inhibition. While the exact mechanisms for this corrosion inhibition is not clearly understood, it is believed that the chromate layer produces protection due both to the corrosion inhibiting effect of the chromium contained in the film and to the physical barrier presented by the film.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

The invention is directed to a method for providing a corrosion inhibiting coating on uranium and uranium alloys. The coating is formed on articles of uranium and uranium alloys of various configurations by the steps of chemically cleaning the surface of uranium articles by using a standard degreasing and cleaning technique, for example, by immersing the articles in an ethylene-chloride bath for degreasing purposes and then electropolishing the uranium surface in phosphoric acid or chromic acid solution after which the articles are rinsed in water, alcohol and blown dry with a pure gas. After chemically cleaning the surface of the uranium articles, they are preferably subjected to an ion-cleaning technique which is achieved by confining the uranium articles in a vacuum chamber and bombarding the uranium surface with ions of inert gas such as argon or the like. After the surfaces of the uranium articles have been adequately cleaned, they are provided with a coating of aluminum or zinc which is achieved through an ion-plating technique as will be described in greater detail below. The ion plating of the surface of the uranium article is of a thickness of at least 60 microinches and up to about 280 microinches. After the completing of the ion-plating operation, the aluminum or zinc is converted to aluminum chromate or zinc chromate by immersing the uranium articles in a commercial chromate bath and at a temperature in range of about 20° to 30° C. The duration required for converting the selected portion of the aluminum or zinc to the chromate thereof depends upon the thickness of the coating and the percentage thereof converted to the chromate form. Satisfactory corrosion protection is provided by converting about 10 to 50 microinches of the ion-plated aluminum or zinc to the chromate and is accomplished by immersion in the chromate solution for 10 to 45 seconds. Typically the commercially available chromate baths contain hexavalent chromium in the presence of other components or "activators" in an acid solution with pH's generally in the range of about 1.8 to 3.2. The hexavalent chromium is partially reduced to trivalent chromium during reaction with the plated layer, forming a complex mixture consisting largely of hydrated basic chromium chromate and hydrous oxides of both chromium and the plated metal.

In order to provide a more facile understanding of the present invention examples are set forth below to be directed to the plating of uranium-0.7 wt.% titanium articles with aluminum chromate and zinc chromate coatings which effectively protect the underlying uranium alloy from corrosion when exposed to corrosion-producing environments.

EXAMPLE I

A plurality of elongated articles of uranium-0.7 wt.% titanium were simultaneously ion plated with aluminum in an ion plating fixture equipped with 12 tungsten filaments each wrapped with type 1100 aluminum wire 6 inches in length and 0.03 inch in diameter. Prior to this ion-plating operation, the uranium alloy articles were first degreased in ethylene chloride, electropolished in a phosphoric acid-chromic acid solution, rinsed in water and alcohol and then blown dry. These cleaned articles were then mounted in the ion-plating fixture and placed in a vacuum chamber having a leak rate of less than about $4.5\times10^{-5}$ atm-cm$^3$/second. The vacuum chamber was evacuated twice, first to a pressure of $25\times10^{-3}$ torr and the other at $5\times10^{-5}$ torr and refilled with argon to a pressure slightly less than atmospheric pressure. The uranium articles were then ion cleaned with argon by applying a negative dc potential of 2 kv to the uranium articles. The speed of the diffusion pump of the vacuum chamber was reduced by throttling the main vacuum valve, and argon gas was admitted into the chamber through a metering valve to provide a current of 200 milliamperes. The uranium articles were ion cleaned for a period of 20 minutes, cooled to 50° C. and again ion cleaned for a 3 minute period with the argon ions. The tungsten filament power supply was then turned on while maintaining a glow discharge around the uranium and uranium alloy articles.

The cleaned uranium alloy articles were then ion plated with aluminum for 3 minutes in the fixture at a voltage of 3.5 kv and an initial current of 60 milliamperes. Upon vaporization of the aluminum, the resulting vapor was drawn into the glow discharge region near the uranium articles to effect the ion plating thereof to a thickness in the range of about 120 to 280 microinches. After the ion plating was completed, the filament power and the high voltage were sequentially terminated. The plating chamber was filled with argon and the articles cooled to an ambient temperature. The surface of ion-plated coatings, to a depth of about 10 to 50 percent microinches were then converted to aluminum chromate in a chromate bath as described above. The bath had a pH in a range of 1.8 to 3.2 and temperature in a range of 20° to 30° C. The uranium alloy articles were dipped in the chromate bath for a 30 second duration, rinsed in water and blown dry with air.

One of the aluminum-chromate coated articles was sectioned for morphological and metallurgical examination. The thickness of the ion-plated aluminum and the aluminum-chromate coating was in the range of about 128 to 280 microinches, with the thinner coating being at the bottom of grooves in the article.

Two more of these chromated aluminum coated articles were tested in a salt spray environment maintained at a temperature of 35° C. for 300 hours. No corrosion was evident on the coated articles except for few places that had the golden appearance of freshly machined uranium-0.7 wt.% titanium. However, a small uncoated portion at the end of each of these articles was severely corroded, so as to illustrate the corrosion inhibiting properties afforded by the aluminum chromate coating of the present invention.

EXAMPLE II

In another demonstration of the present invention a uranium-0.7 wt.% titanium article was coated with a protective layer of zinc chromate. Four resistance reheated tantalum boats were used in a vacuum chamber for vaporization of the zinc. The boats were each 4.8 inches in length and designed for rapidly heating zinc. Each boat was loaded with a rectangular charge of zinc having a length of 2.6 inches and a width and height of 0.26 inch. As in Example I, the surface of the article were first chemically cleaned and then bombarded with argon ions to provide a surface to which the zinc may be applied in a very adherent manner. Uranium alloy articles were ion-plated with zinc for 10 minutes by resistance heating of the tantalum boats and maintaining the power supply at a voltage of about 3 kv. The zinc-coated article was cooled to an ambient temperture in argon and then the outer portion of the zinc coating was converted to zinc chromate in a chromate solution as in Example I.

It will be seen that the present invention provides a very simple reproducible method by which uranium and uranium alloy articles may be provided with a coating which effectively protects the uranium and uranium alloys from corrosion when subjected to corrosive atmospheres.

What is claimed is:

1. A new article of manufacture comprising a uranium or uranium alloy substrate and a corrosion-resistant coating on exposed surfaces of said substrate, said coating consisting essentially of ion-plated aluminum or zinc with at least the outer surface of said coating being formed of aluminum or zinc chromate, said coating being of a thickness in the range of about 60 to 280 microinches, and said aluminum chromate or zinc chromate providing about 10 to 50 microinches of the thickness of said coating.

* * * * *